US006568301B2

(12) United States Patent
Huang

(10) Patent No.: US 6,568,301 B2
(45) Date of Patent: May 27, 2003

(54) ADJUSTABLE WRENCH

(76) Inventor: Ping Wen Huang, 1F, No. 364, Sec. 2, Chung-Yang Rd., Hsien-Hsi Tsun, Chang Hua Hsien (TW)

( * ) Notice: Subject to any disclaimer, the term of this patent is extended or adjusted under 35 U.S.C. 154(b) by 0 days.

(21) Appl. No.: 09/970,863

(22) Filed: Oct. 5, 2001

(65) Prior Publication Data

US 2002/0035898 A1 Mar. 28, 2002

Related U.S. Application Data

(63) Continuation-in-part of application No. 09/667,627, filed on Sep. 22, 2000, now Pat. No. 6,336,384.

(51) Int. Cl.[7] ..... B25B 13/14
(52) U.S. Cl. ..... 81/165; 81/129
(58) Field of Search ..... 81/129, 165

(56) References Cited

U.S. PATENT DOCUMENTS 1,490,903 A * 4/1924 Anderson ..... 81/165
2,562,060 A * 7/1951 Pehrsson ..... 81/165
2,733,626 A * 2/1956 Mesojedec ..... 81/165
3,349,654 A * 10/1967 Nordgren ..... 81/165
5,297,459 A * 3/1994 Stojanowski ..... 81/165
5,941,142 A * 8/1999 Janson ..... 81/165
6,336,384 B1 * 1/2002 Huang ..... 81/165

* cited by examiner

*Primary Examiner*—James G. Smith
(74) *Attorney, Agent, or Firm*—Rosenberg, Klein & Lee

(57) ABSTRACT

An adjustable wrench including a main body, a slide block, a movable jaw and a handle. The main body is formed with a hollow section in which the slide block is transversely slidably disposed. An adjustment bolt is pivotally disposed on the slide block and engaged with the movable jaw. One side of the slide block adjacent to the handle is formed with a dented section. The handle has at least one stop member corresponding to the dented section for abutting against the slide block. When the handle is wrenched, the stop member abuts against and locate the slide block so as to fix the movable jaw. At this time, the fixed jaw and movable jaw can clamp and wrench a work piece. When the handle is wrenched in reverse direction, the stop member is disengage from the slide block, whereby the slide block and the movable jaw are pushed open by the work piece and idle. Accordingly, the adjustable wrench can one-way wrench the work piece.

3 Claims, 7 Drawing Sheets

ADJUSTABLE WRENCH

CROSS-REFERENCE TO RELATED APPLICATION

This application is a Continuation-In-Part Application of Ser. No. 09/667,627, filed Sep. 22, 2000, and entitled "ADJUSTABLE WRENCH" now U.S. Pat. No. 6,336,384.

BACKGROUND OF THE INVENTION

The present invention is related to an adjustable wrench which has simple structure and can truly one-way wrench a work piece.

FIGS. 6 and 7 show a conventional adjustable wrench 8 having a main body 81. A fixed jaw 82 extends from one side of the main body 81, while a handle 83 is pivotally connected with the other end of the main body 81. A movable jaw 84 is slidably disposed in a slide slot 811 of the main body 81. The movable jaw 84 has a push block 841 protruding out from the main body 81. A driving section 831 is formed at front end of the handle 83 in the main body 81. The driving section 831 abuts against a slide block 85 having a toothed section 851. The driving section 831 serves to drive the slide block 85 to make the toothed section 851 thereof disengage from or engage with a toothed section 842 of the movable jaw 84. When the handle 83 is clockwise wrenched to drive the slide block 85 to engage with the movable jaw 84, the fixed jaw 82 and the movable jaw 84 can cooperatively clamp and wrench a work piece 9 such as a bolt or a nut. When the handle 83 is counterclockwise wrenched, the slide block 85 is moved away from the movable jaw 84. Therefore, when the main body 81 is driven by the handle 83, the movable jaw 84 is pushed open by the work piece 9 and idles. Accordingly, when reciprocally turned, the adjustable wrench 8 can only one-way wrench the work piece 9.

The above structure is relatively complicated and is hard to manufacture. Moreover, when reciprocally turning the adjustable wrench 8, the toothed section 851 of the slide block 85 will frequently reciprocally move to engage with or disengage from the toothed section 842 of the movable jaw 84. As a result, the toothed section 851 of the slide block 85 and the toothed section 842 of the movable jaw 84 are subject to wear after a period of use. Such toothed sections can hardly further truly engage with each other. This will make the movable jaw 84 unable to firmly clamp a work piece 9.

SUMMARY OF THE INVENTION

It is therefore a primary object of the present invention to provide an adjustable wrench in which the main body is formed with a hollow section. A slide block is transversely slidably disposed in the hollow section. An adjustment bolt is pivotally disposed on the slide block and engaged with the movable jaw. One side of the slide block adjacent to the handle is formed with a dented section. The handle has at least one stop member corresponding to the dented section for abutting against the slide block. When the handle is wrenched, the stop member abuts against and locate the slide block so as to fix the movable jaw. At this time, the fixed jaw and movable jaw can clamp and wrench a work piece. When the handle is wrenched in reverse direction, the stop member is disengage from the slide block, whereby the slide block and the movable jaw are pushed open by the work piece and idle. Accordingly, the adjustable wrench is durable and can one-way wrench the work piece.

The present invention can be best understood through the following description and accompanying drawings wherein:

DETAILED DESCRIPTION OF THE PREFERRED EMBODIMENT

Figure 1:
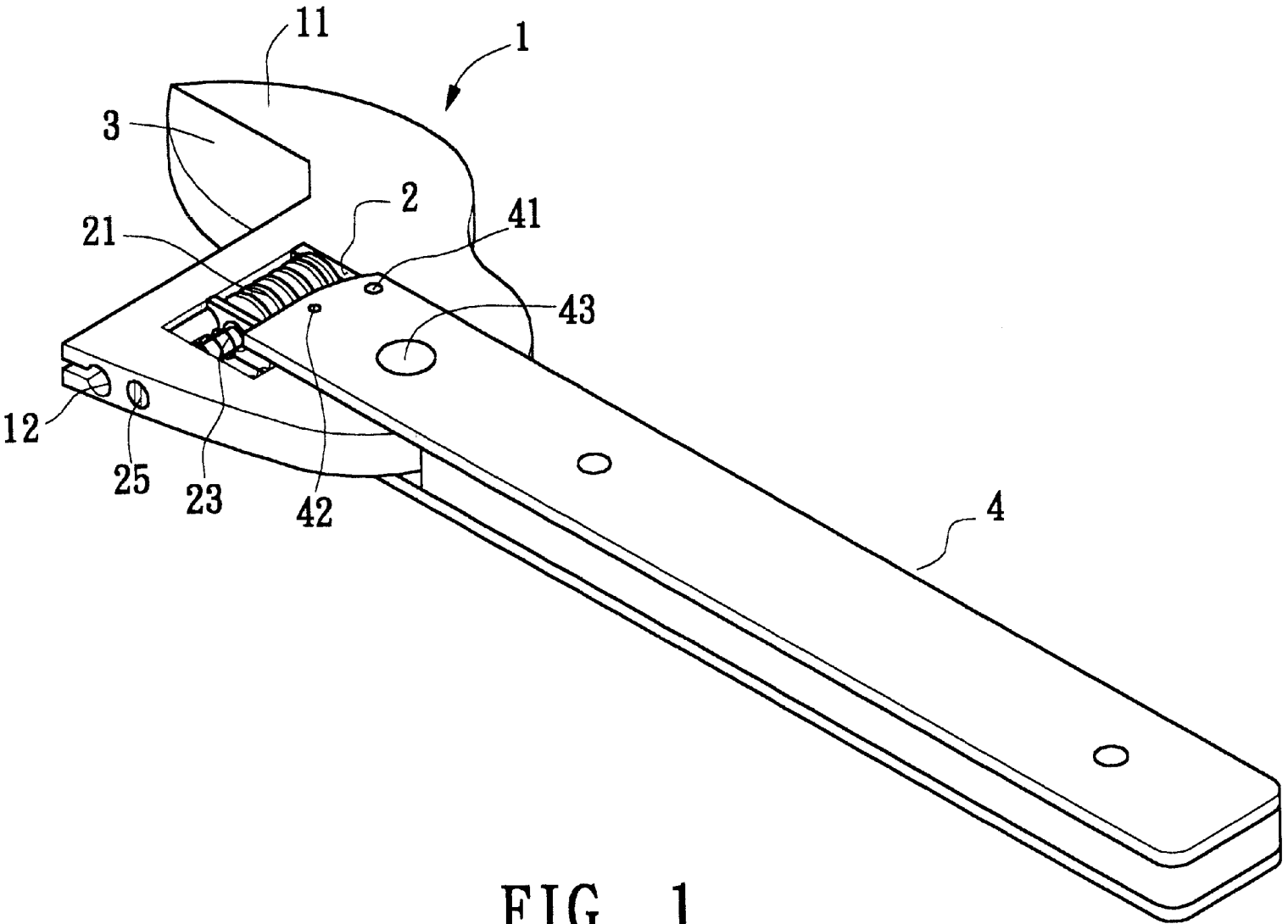
FIG. 1 is a perspective assembled view of the present invention.
Figure 2:
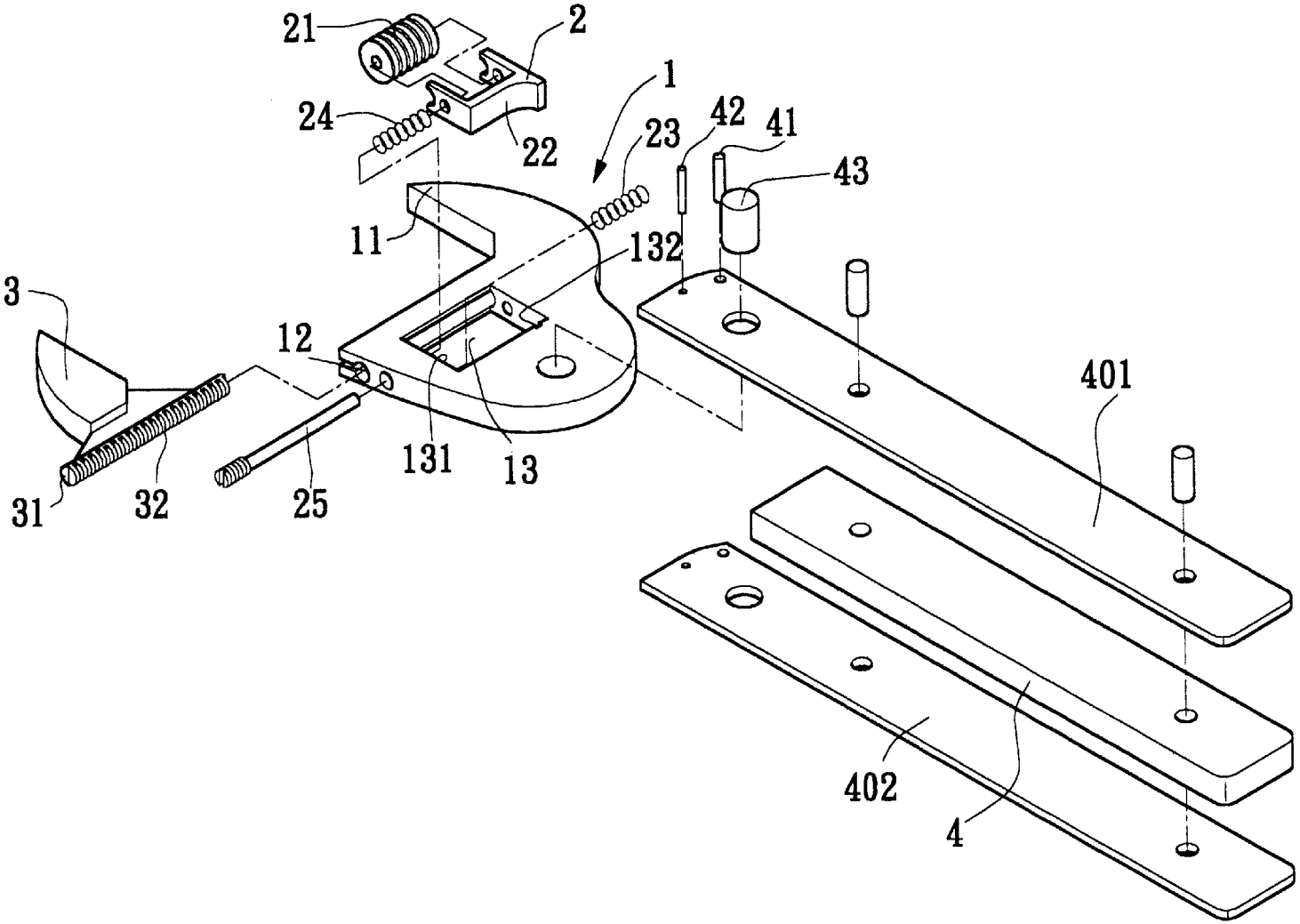
FIG. 2 is a perspective exploded view of the present invention.
Figure 3:
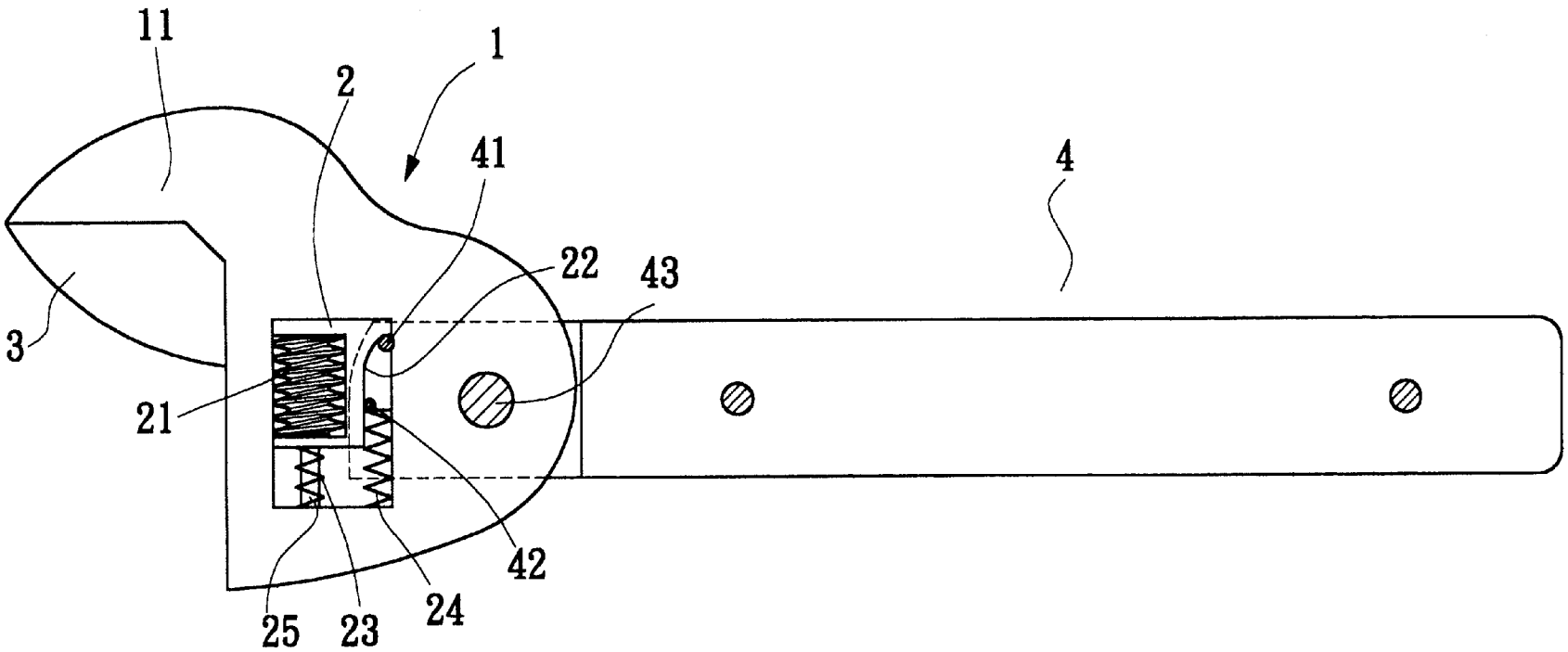
FIG. 3 is a sectional assembled view of the present invention.

Please refer to FIGS. 1 to 3. The adjustable wrench of the present invention includes a main body 1, a slide block 2 slidably mounted in the main body 1, a movable jaw 3 partially and slidably received in the main body and a handle 4 attached to the main body 1. The main body 1 has a fixed jaw 11 projecting therefrom and corresponding to the movable jaw 3. A slide channel 12 is defined in a top section of the main body 1 and the movable jaw 3 is partially slidably disposed in the slide channel 12. The movable jaw 3 has a rail 31 slidably received in the slide channel 12. One end of the main body 1 opposite to the fixed jaw 11 is pivotally connected with the handle 4. A hollow section 13 is defined in and extends through the main body 1. The slide block 2 is mounted in the hollow section 13. The handle 4 has two panels 401, 402 connected with a top and a bottom faces of the handle 4 for clamping the main body 1.

A pin member 25 extends through the slide block 2 to assemble the slide block 2 with the main body 1 in the hollow section 13, whereby the slide block 2 can be transversely slid within the hollow section 13. An adjustment bolt 21 is pivotally connected with the slide block 2. The movable jaw 3 has a toothed section 32 engaged with the adjustment bolt 21. By means of turning the adjustment bolt 21, the position of the movable jaw 3 can be changed. One side of the slide block 2 opposite to the adjustment bolt 21 is formed with a dented section 22. The handle 4 has a first stop member 41 and a second stop member 42 extending therethrough and corresponding to the dented section 22. A first spring 24 is positioned between the second stop member 42 and a lateral wall 131 of the hollow section 13. The first spring 24 serves to resiliently push the second stop member 42, making the first stop member 41 abut against a bottom of the dented section 22 of the slide block 2. A second spring 23 is positioned between the slide block 2 and the lateral wall 131 of the hollow section 13. The first and second springs 24, 23 resiliently push and locate the slide block 2. The first and second stop members 41, 42 are rotatable about the pivot member 43 of the handle 4 and the main body 1. The hollow section 13 has an engaging notch 132 defined in a bottom of the hollow section 13 and corresponding to the first stop member 41 in home position. The first stop member 41 is inlaid in the engaging notch 132 to locate the slide block 2.

Figure 4:
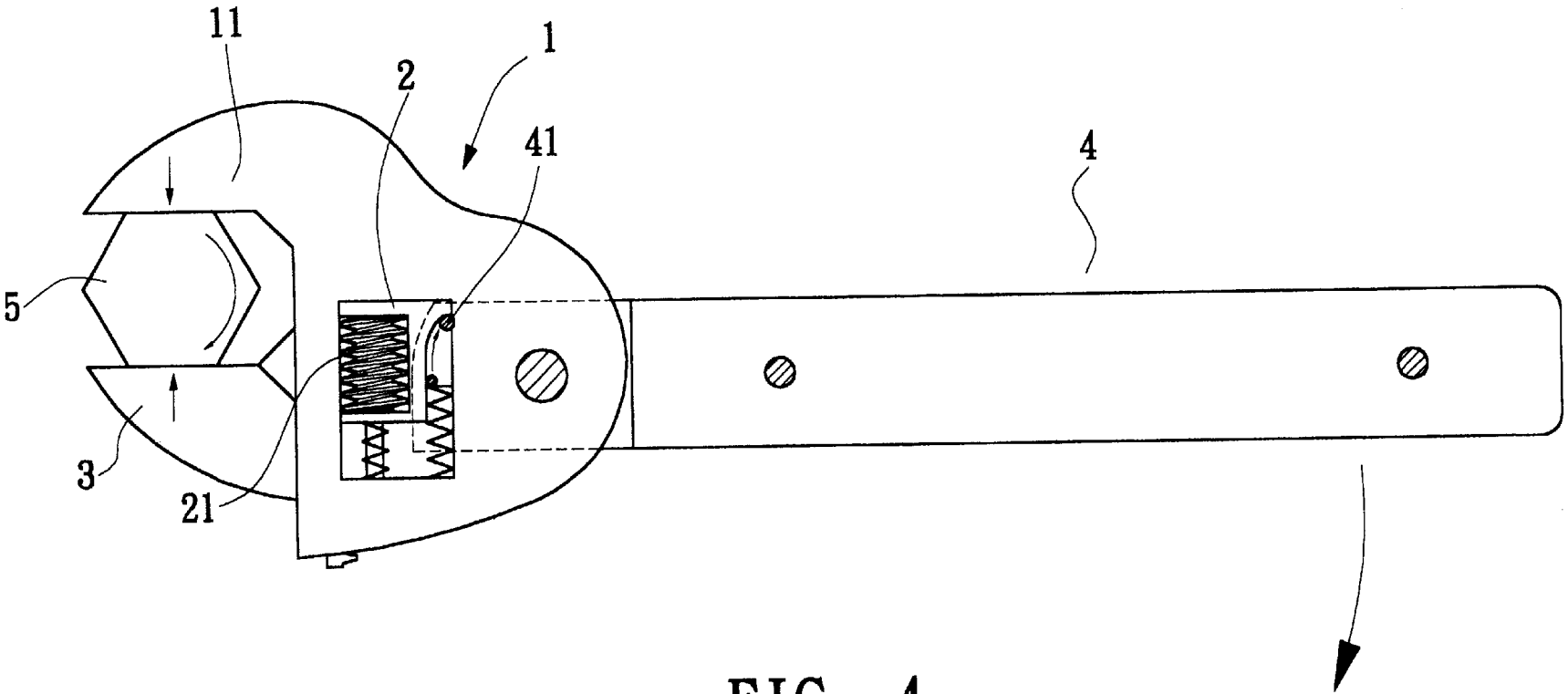
FIG. 4 shows the use of the present invention in one state.
Figure 5:
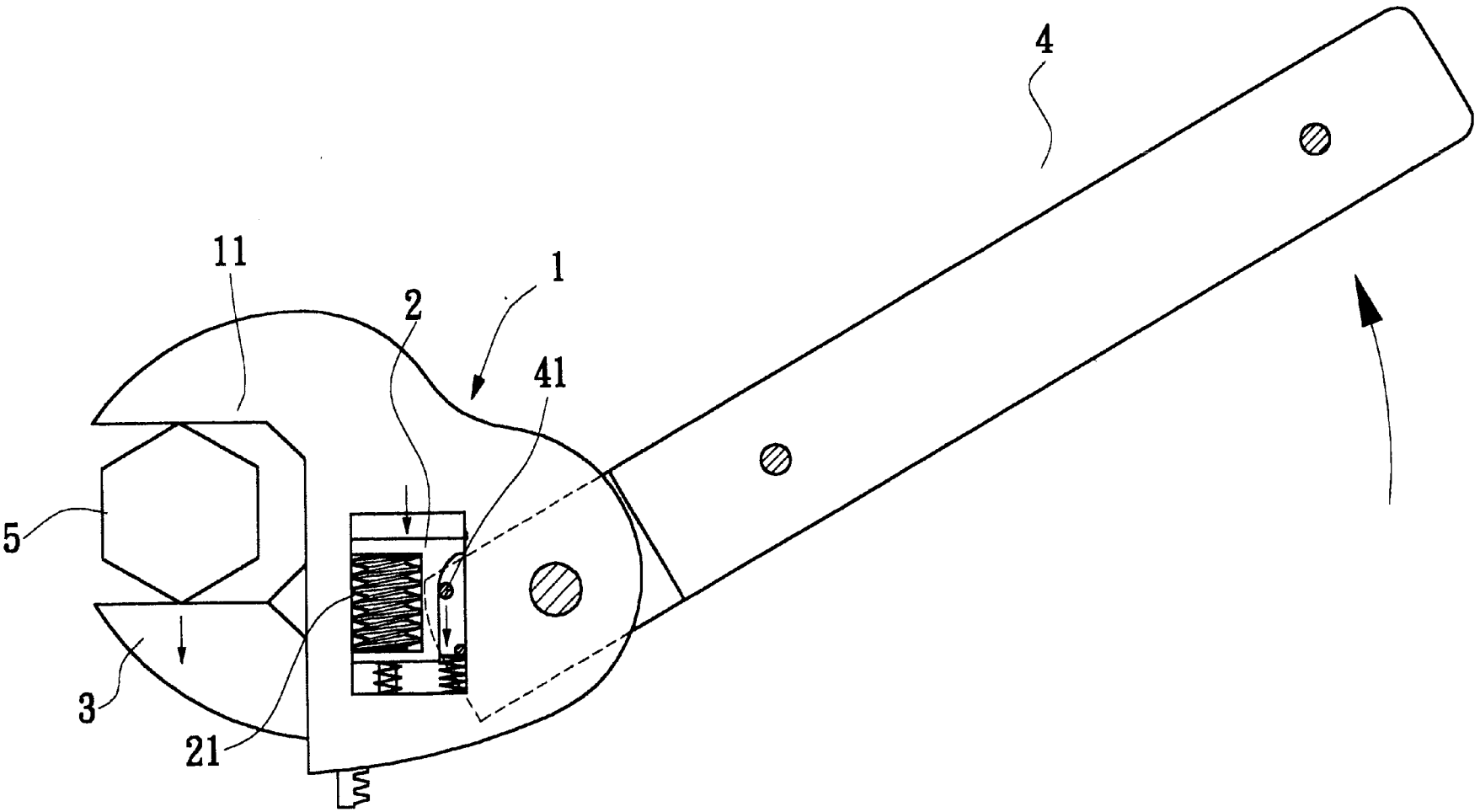
FIG. 5 shows the use of the present invention in another state.
Figure 6:
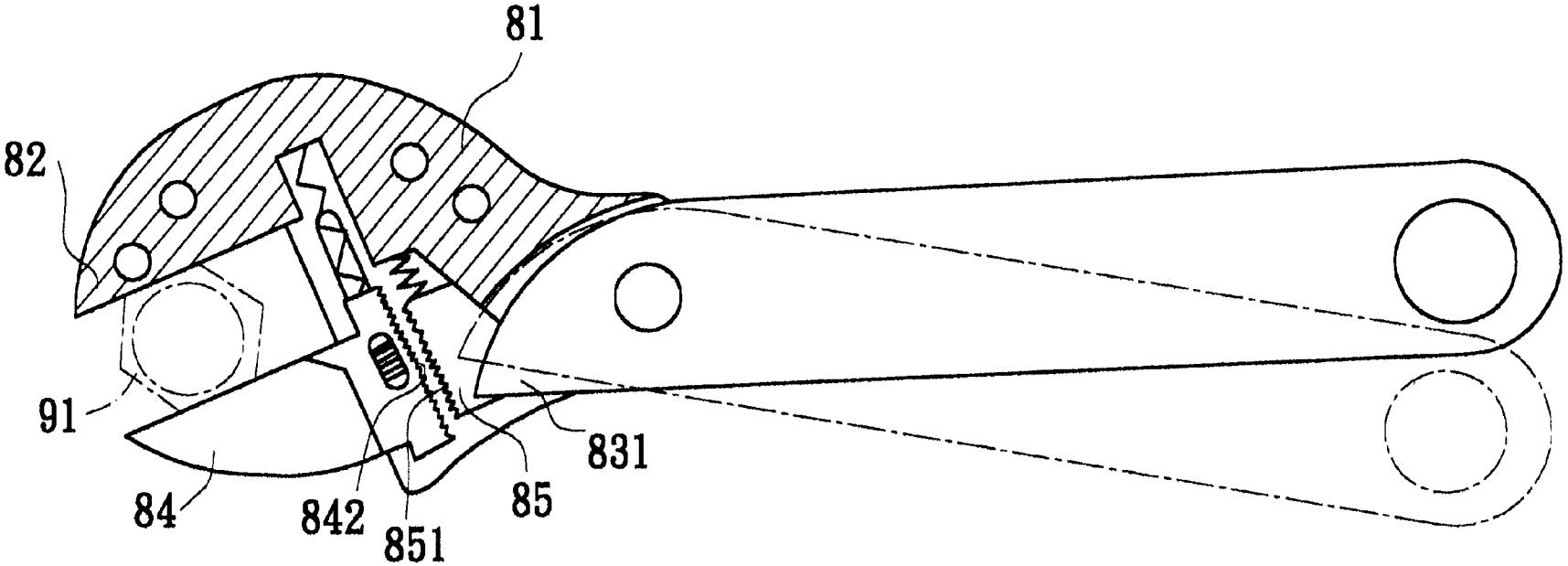
PRIOR ART FIG. 6
FIG. 6 shows a conventional adjustable wrench.
Figure 7:
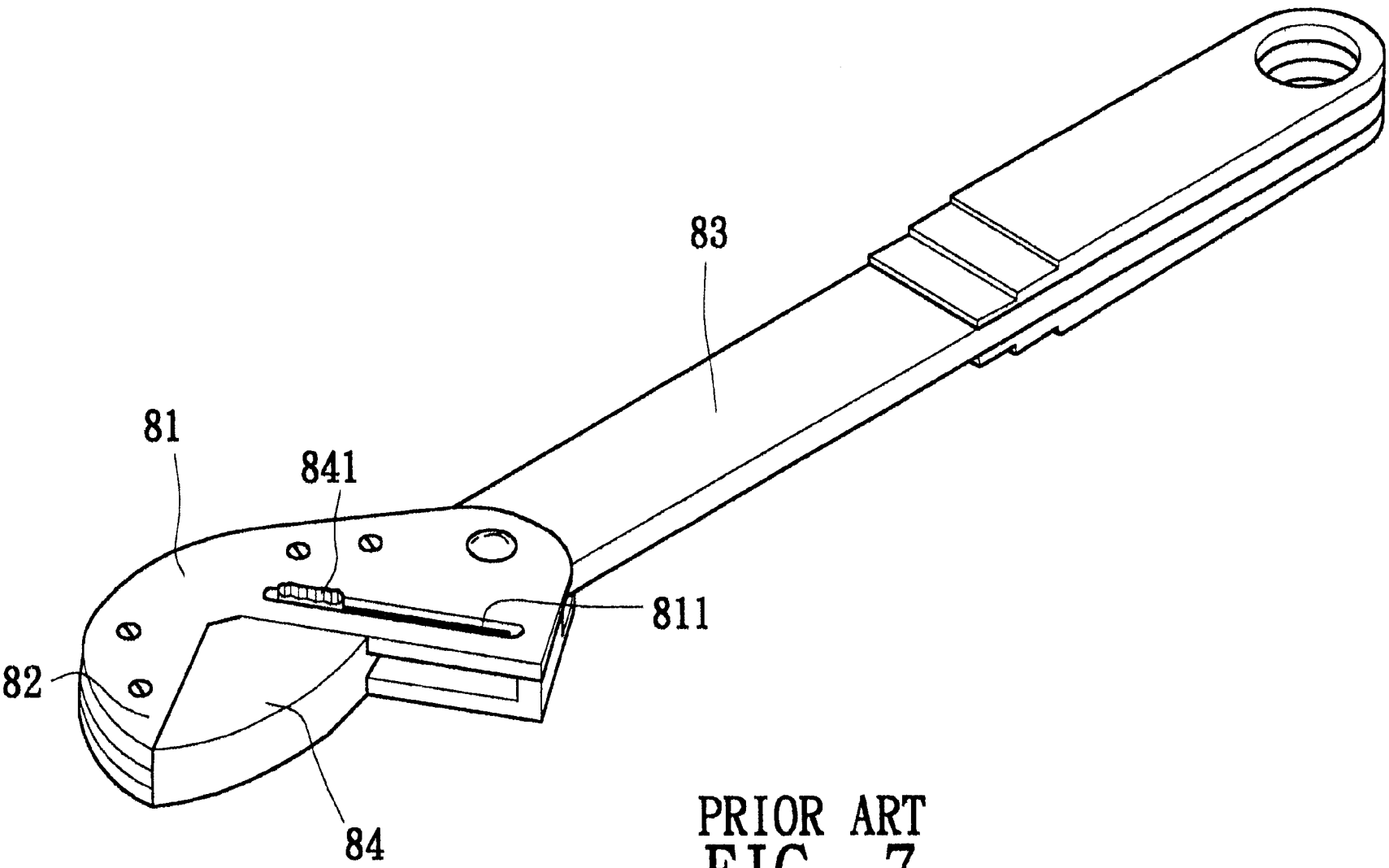
PRIOR ART FIG. 7
FIG. 7 shows the operation of the conventional adjustable wrench.

Referring to FIG. 4, in use, the fixed jaw 11 and the movable jaw 3 clamp a work piece 5, when a user clockwise wrenches the handle, the first stop member 41 is rotated about the pivot member 43 to abut against the dented section 22 of the slide block 2 and push the slide block 2 in a direction to the fixed jaw 11. By means of the adjustment bolt 21, the movable jaw 3 is forced to clamp the work piece 5. Then, the work piece 5 can be clockwise wrenched. Referring to FIG. 5, when the user counterclockwise wrenches the handle 4, the first stop member 41 is counterclockwise rotated about the pivot member 43 and disengage from the dented section 22 of the slide block 2. Under such circumstance, the slide block 2 and the movable jaw 3 are in a free state. At this time, the work piece 5 will push away the movable jaw 3 and idle. Accordingly, when reciprocally turned, the adjustable wrench can one-way wrench the work piece S.

The first stop member 41 abuts against and forces the slide block 2 to make the movable jaw 3 and the fixed jaw 11 clamp the work piece 5. Therefore, the problem of failing to truly clamp the work piece caused by the wear of toothed sections is eliminated.

The above embodiment is only used to illustrate the present invention, not intended to limit the scope thereof. Many modifications of the above embodiment can be made without departing from the spirit of the present invention.

What is claimed is:

1. An adjustable wrench comprising a main body, a slide block slidably mounted in the main body, a movable jaw partially and slidably received in the main body and a handle pivotally attached to the main body by a pivot member, the main body having a fixed jaw projecting therefrom and corresponding to the movable jaw, a slide channel defined in a top section of the main body and the movable jaw partially slidably disposed in the slide channel, one end of the main body opposite to the fixed jaw being pivotally connected with the handle, a hollow section defined in and extending through the main body, the slide block mounted in the hollow section, said adjustable wrench being characterized in that the slide block is only transversely slid within the hollow section, an adjustment bolt pivotally connected with the slide block, the movable jaw having a toothed section engaged with the adjustment bolt, by means of turning the adjustment bolt, the position of the movable jaw being changeable, one side of the slide block opposite to the adjustment bolt being formed with a dented section, the handle having a stop member extending therethrough and corresponding to the dented section for abutting against the slide block, a first resilient member being positioned between the stop member and a lateral wall the hollow section, the first resilient member serving to resiliently push the stop member to push the slide block to move in a direction toward the fixed jaw.

2. The adjustable wrench as claimed in claim 1, wherein the stop member is rotatable about the pivot member of the handle and the main body, the hollow section having an engaging notch defined in bottom of the hollow section and corresponding to the stop member in home position, whereby the stop member is inlaid in the engaging notch to locate the slide block.

3. The adjustable wrench as claimed in claim 1 further comprising a second resilient member positioned between the slide block and the lateral wall of the hollow section distal from the fixed jaw for resiliently pushing and locating the slide block.

* * * * *